US010400496B2

(12) United States Patent
Kuta et al.

(10) Patent No.: US 10,400,496 B2
(45) Date of Patent: Sep. 3, 2019

(54) DOOR STOP AND MOUNT

(71) Applicants: NO SLAM LTD., Calgary (CA); Jeremy Loewen, Calgary (CA); Douglas Grelowski, Calgary (CA)

(72) Inventors: Levi Garrett Kuta, Airdrie (CA); Jeremy Loewen, Calgary (CA); Douglas Grelowski, Calgary (CA)

(73) Assignees: NO SLAM LTD., Calgary, Alberta (CA); Jeremy Loewen, Calgary, Alberta (CA); Douglas Grelowski, Calgary, Alberta (CA)

( * ) Notice: Subject to any disclaimer, the term of this patent is extended or adjusted under 35 U.S.C. 154(b) by 0 days.

(21) Appl. No.: 15/898,510

(22) Filed: Feb. 17, 2018

(65) Prior Publication Data

US 2018/0305965 A1 Oct. 25, 2018

Related U.S. Application Data

(60) Provisional application No. 62/487,250, filed on Apr. 19, 2017.

(51) Int. Cl.
*E05F 5/06* (2006.01)
*E05F 5/08* (2006.01)
(Continued)

(52) U.S. Cl.
CPC ..... *E05F 5/06* (2013.01); *E05C 17/46* (2013.01); *E05C 17/56* (2013.01); *E05F 5/08* (2013.01);
(Continued)

(58) Field of Classification Search
CPC ..... E05F 5/02; E05F 5/06; E05F 5/08; Y10T 16/61; Y10T 16/628; Y10T 16/6285;
(Continued)

(56) References Cited

U.S. PATENT DOCUMENTS 1,127,854 A * 2/1915 Belanski ..... E05C 19/063 16/82
1,628,826 A * 5/1927 Covalence ..... E05F 5/06 16/85
(Continued)

OTHER PUBLICATIONS

International Search Report dated Apr. 25, 2018 by the Canadian Intellectual Property Office as the Searching Authority in connection with International Patent Application No. PCT/CA2018/000030, 3 pages.
(Continued)

*Primary Examiner* — Jeffrey O'Brien

(57) ABSTRACT

The present disclosure generally relates a stop apparatus for use with a system comprising: a first component having a first surface; and a second component having a second surface. The second component is movable relative to the first component. The first surface and the second surface are disposed at different orientations when the first surface is located in proximity to the second surface. The stop apparatus is operable to be disposed between the two surfaces and operable to prevent them directly contacting each other. The apparatus may comprise an elongated body and an adjustable setting mount assembly inter-connected to the body. The mount assembly is operable to selectively adjust the angle at which the body is mounted relative to the first mounting surface over a range of angles.

14 Claims, 7 Drawing Sheets

(51) Int. Cl.
*E05C 17/46* (2006.01)
*E05C 17/56* (2006.01)
*E05C 17/50* (2006.01)

(52) U.S. Cl.
CPC ..... *E05C 17/50* (2013.01); *E05Y 2201/224* (2013.01); *E05Y 2201/46* (2013.01); *E05Y 2201/638* (2013.01); *E05Y 2600/13* (2013.01); *E05Y 2600/60* (2013.01); *E05Y 2600/634* (2013.01); *E05Y 2900/132* (2013.01); *Y10T 16/61* (2015.01)

(58) Field of Classification Search
CPC ..... E05C 17/46; E05C 17/50; E05C 17/52; E05C 17/56
See application file for complete search history.

(56) References Cited

U.S. PATENT DOCUMENTS 2,432,150 A * 12/1947 Hagstrom ..... E05F 5/06 16/86 A
2,449,686 A * 9/1948 Brinda ..... E05F 5/06 16/85
2,454,414 A * 11/1948 La Moil ..... E05C 17/525 16/86 A
2,462,174 A * 2/1949 Fisher ..... E05F 5/06 16/86 A
2,479,597 A * 8/1949 Anton ..... E05F 5/06 16/85
2,761,718 A * 9/1956 Tool ..... E05C 17/56 16/85
3,163,453 A * 12/1964 Stephens ..... E05C 17/56 292/251.5
3,180,666 A * 4/1965 Jorgensen ..... E05C 17/52 138/122
3,187,372 A * 6/1965 Parsons ..... E05F 5/06 16/375
3,244,443 A * 4/1966 Rodgers ..... E05C 17/56 16/82
3,913,171 A * 10/1975 Reid ..... E05D 11/06 16/342
4,218,807 A * 8/1980 Snow ..... E05F 5/08 16/86 A
4,669,766 A * 6/1987 Hanchett, Jr. ..... E05C 17/56 292/251.5
4,995,655 A * 2/1991 Freeman ..... E05C 17/56 292/251.5
5,010,622 A * 4/1991 Morita ..... E05C 17/56 16/82
5,082,317 A * 1/1992 Delaney, Jr. ..... E05C 17/56 292/251.5
5,836,049 A * 11/1998 Chiang ..... E05C 17/50 16/82
6,676,201 B2 * 1/2004 Im ..... B60J 5/101 16/82
6,732,410 B1 * 5/2004 Nedderman, Jr. ..... E05F 5/02 16/371
7,536,746 B2 * 5/2009 Rutledge ..... B64C 1/14 16/82
8,864,188 B2 * 10/2014 Redgrave ..... E05C 19/16 292/251.5
9,267,317 B2 * 2/2016 Vu ..... E05F 5/06
9,915,088 B2 * 3/2018 Catalano ..... E05F 5/06
2004/0045128 A1 * 3/2004 Frushour ..... E05C 17/56 16/82
2004/0200033 A1 * 10/2004 Davis ..... E05F 5/06 16/49
2005/0229358 A1 * 10/2005 Barone ..... E05C 17/56 16/82
2006/0152019 A1 * 7/2006 Depasquale ..... E05C 17/56 292/251.5
2006/0218747 A1 * 10/2006 Davis ..... E05F 5/06 16/49
2007/0006418 A1 * 1/2007 Jones ..... E05F 5/06 16/82
2007/0113376 A1 * 5/2007 Frushour ..... E05C 17/56 16/83
2007/0163077 A1 * 7/2007 Yang ..... E05F 5/06 16/85
2010/0132161 A1 * 6/2010 Vu ..... E05F 5/08 16/404
2012/0124776 A1 * 5/2012 McDonnell ..... E05D 11/06 16/375

OTHER PUBLICATIONS

Written Opinion of the International Searching Authority dated Apr. 25, 2018 by the Canadian Intellectual Property Office in connection with International Patent Application No. PCT/CA2018/000030, 5 pages.
Bunnings Warehouse, "Adoored Satin Chrome Trumpet Magnetic Door Stop", Aug. 6, 2016, Retrieved online from <https://www.bunnings.com.au/adoored-satin-chrome-trumpet-magnetic-door-stop_p4133223>, 1 page.
noslam.ca, Instruction Manual—Installation Instructions, https://img1.wsimg.com/blobby/go/4a1bc5d8-3a8a-484d-acf6-6e288d405ea9/downloads/1cgp0ruti_208872.pdf?ver=1557173220162, Canada, went live on website as early as Feb. 22, 2017, 1 page.

* cited by examiner

DOOR STOP AND MOUNT

CROSS-REFERENCE TO RELATED APPLICATION

The present application claims priority to U.S. Provisional Patent Application Ser. No. 62/487,250 filed Apr. 19, 2017, the entire contents of which is hereby expressly incorporated herein by reference.

FIELD

The present disclosure relates to a stop assembly that may be employed as a door stop assembly and related mounting thereof. A door stop assembly is disclosed that may have an adjustable mount assembly which allows the door stop assembly to be used in connection with a variety of shaped or angled mounting surfaces to retain a first component such as a door in an open position and/or to prevent a surface of the first component from contacting a surface of another component (eg. a wall of a building) located near to the first component when the first component moves relative to the second component.

BACKGROUND

Door stops may be used in a variety of settings to maintain a door in an open or partially open position. Additionally, door stops can be used to protect an adjacent surface, such as a wall or baseboard, from being damaged by the door or its hardware (for e.g. a door knob) when the door is opened too quickly.

Wedge-shaped door stops have been used to maintain a door in an open position by inserting the pointed end of the wedge between the floor and the bottom surface of the door so that one face of the wedge engages the door and the other face engages the surface of the floor. While effective, wedge-shaped door stops have been found to be inconvenient since they must be disengaged from the door and surface of the floor when it's desired to close the door and then reengaged in order to retain in an open position. Additionally, the floor may be damaged due to friction between the wedge-shaped door stop and floor surface. Furthermore, wedge-shaped door stops will not stop the door or door knob from slamming into and ruining an adjacent wall.

An alternative to wedge-shaped door stops are wall or floor-mounted door stops. Such door stops are typically elongate members having a first end that is attached to a wall, baseboard, floor or other mounting surface, and a second end having a mechanism, to retain the door, such as a magnet. Thus, when a ferromagnetic-containing strike plate located on the door is brought into close proximity of the second end, the magnet generates a holding force to retain the door in an open position. Although such door stops are more convenient to use then wedge-shaped door stops, the surface upon which the door stop is mounted can vary widely in shape and angle relative to the door and strike plate, making mounting of the door stop troublesome. For example, door stops are often mounted to baseboards running along the bottom edge of a wall. Such baseboards can vary in shape and size as well as being curved or angled where mounting is desired. In addition, there may be some instances where the door is either too close or far away from the mounting surface. In both situations, the strike plate will contact the door stop at an angle relative to the mounting surface resulting in a suboptimal engagement and therefore weak or ineffective retention of the door.

U.S. Pat. No. 2,454,414 discloses a solution to address the above-issue by inserting an angled c-shaped washer between the retaining mechanism and body of the door stop. However, the washer is only capable of remaining at one angle relative to the axis of the body of the door stop. In addition, because the washer is not secured to the body, it may be inadvertently knocked out or slide out due to repeated contact between the door stop and door. Finally, an accidental kicking of the door stop when walking past the door may cause the washer to rotate out of alignment with the surface of the door.

Therefore, there is a need for a stop apparatus such a door stop apparatus that may be used in association with a variety mounting surfaces, and which may reliably maintain a desired orientation for optimally engaging with the surface of a component such as a door to retain said component.

In one broad aspect, a mount for a door stop is provided, comprising a first oblique, truncated cylindrical base portion having a mounting face, a first engagement face at a first angle to the mounting face, and a plurality of recesses spaced about the first engagement face; a second oblique, truncated cylindrical adapter portion having a connecting face, a second engagement face a second angle to the connecting face, said connecting face having a first connection means for connecting with a door stop body, and one or more protrusions spaced about the second engagement face shaped and sized to be complementary to the plurality of recesses; and a coupling means for rotatably coupling the base portion and adapter portion.

In another broad aspect, a door stop is provided, comprising a body coupled to the means for coupling of the mount of claim 1, said body having a coupling end and a stop end; and a door retaining means located at the stop end.

In an embodiment, the present disclosure relates to a stop apparatus for use with a system that comprises a first component having a first surface, a second component having a second surface, the second component movable relative to the first component, where the first surface and the second surface are disposed at different orientations when the first surface is located in proximity to the second surface, and where the stop apparatus is operable to be disposed between the first surface of the first component and the second surface of the second component and operable to prevent the first surface from contacting the second surface, and where the stop apparatus comprises an elongated body and an adjustable setting mount assembly inter-connected to the body, the mount assembly operable to mount the elongated body to the first surface, the mount assembly being operable to selectively adjust the angle at which the body is mounted relative to the first mounting surface over a range of angles.

In another embodiment, the present disclosure relates to a stop apparatus for use with a system that comprises a first component having a first surface, a second component having a second surface, the second component movable relative to the first component, where the first surface and the second surface are disposed at different orientations when the first surface is located in proximity to the second surface, and where the stop apparatus is operable to be disposed between the first surface of the first component and the second surface of the second component, the stop apparatus being secured to the first component and operable to releasably engage with the second component with a retention mechanism, and where the stop apparatus comprises an elongated body and an adjustable setting mount assembly inter-connected to the body, the mount assembly operable to mount the elongated body to the first surface, the adjustable mount assembly being operable to selectively adjust the angle at which the body is mounted relative to the first mounting surface over a range of angles.

In a further embodiment, the present disclosure relates to a system that comprises a first component having a first surface, a second component having a second surface, the second component movable relative to the first component, a stop apparatus disposed between the first component and the second component and operable to prevent the first component from contacting the second surface, and where the stop apparatus comprises an apparatus as described above.

In a further embodiment, the present disclosure relates to an adjustable setting mount assembly for use with a door stop that comprises a base truncated disk comprising a mounting face, a first engagement face at a first angle to the mounting face and a plurality of recesses spaced about the first engagement face, an adapter truncated disk comprising a connecting face, a second engagement face at a second angle to the connecting face and one or more protrusions spaced about the second engagement face shaped and sized to be complementary to the plurality of recesses, and a mechanical fastener for rotatably coupling the base truncated disk and adapter truncated disk.

In a further embodiment, the present disclosure relates to a method for releasably holding a door in an open position and/or for preventing the door from slamming into an adjacent surface using a door stop assembly, the door stop assembly comprising an adjustable setting mount assembly and elongated member and a strike plate comprising a ferromagnetic material. The method comprises attaching the strike plate to the door, attaching the adjustable setting mount assembly to a mounting surface with a mechanical fastener, selecting an orientation for the adjustable setting mount assembly to compensate for an angle inclination of the mount assembly and securing the adjustable setting mount assembly to the mounting surface by tightening the mechanical fastener, coupling adjustable setting mount assembly and elongated member to form the door stop assembly, and engaging the door stop assembly and strike plate to releasably hold the door open and/or to prevent the door from striking the surface adjacent to the door.

In a further embodiment, the present disclosure relates to a method for configuring a door stop assembly, the door stop assembly comprising an adjustable setting mechanism and a body portion, the adjustable setting mounting operable to selectively adjust the angle at which the body portion is mounted relative to the first mounting surface over a range of angles. The method comprises selecting a setting for the adjustable setting mount mechanism to compensate for an angle of inclination of a mounting surface, and securing the door stop assembly to the mounting surface.

DETAILED DESCRIPTION

Figure 1:
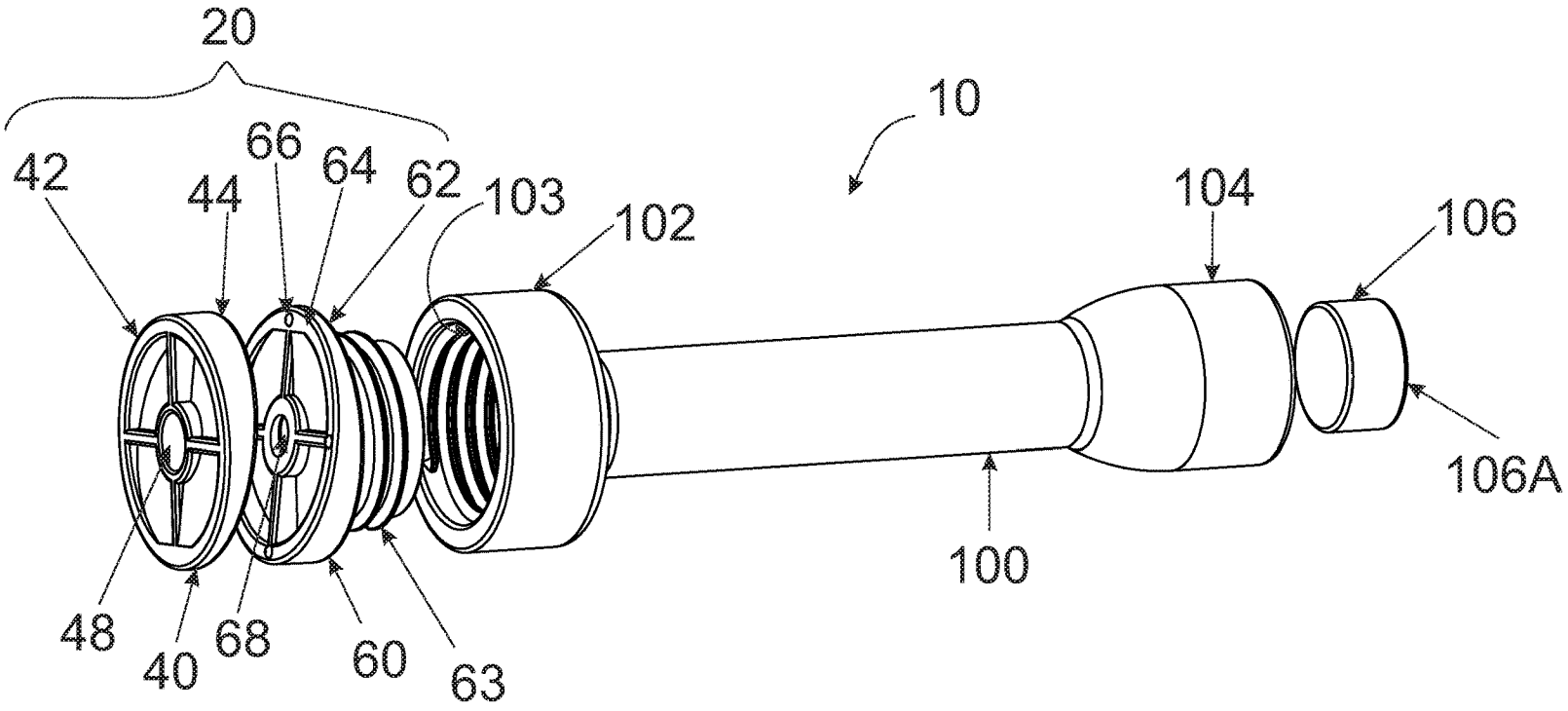
FIG. 1 is an exploded perspective view of a door stop assembly according to an aspect of the present disclosure.

Embodiments herein relate to an improved door stop assembly for releasably holding a door open and preventing the door from opening too much or too far. The door stop assembly is adaptable for use with mounting surfaces of varying shapes and angles. The door stop extends from a wall along an axis, and is capable of rotating about its axis X between at least a first position wherein the door stop extends in a direction X' orthogonal from the mounting surface, and a second position X wherein the door stop extends at an angle from the mounting surface (see FIG. 3). Once the desired position is selected, the position of the door stop can only be changed if a coupling member is intentionally loosened, mitigating the risk of accidental rotation of the door stop.

The present disclosure is generally directed to a stop assembly such as a door stop assembly that may for example releasably hold a door open and/or prevent the door from slamming into a surface adjacent to the door. The door stop assembly of the present disclosure may include an elongated member and an adjustable setting mount assembly. The adjustable setting mount assembly may comprise a plurality of truncated disks, the disks may have index engagement faces which form an indexing mechanism which, when engaged may be used to selectively, incrementally, adjust the position/orientation of the mount assembly.

The following terms shall have the following meanings:

The term "comprising" and derivatives thereof are not intended to exclude the presence of any additional component, step or procedure, whether or not the same is disclosed herein. In contrast, the term, "consisting essentially of" if appearing herein, excludes from the scope of any succeeding recitation any other component, step or procedure, except those that are not essential to operability and the term "consisting of", if used, excludes any component, step or procedure not specifically delineated or listed. The term "or", unless stated otherwise, refers to the listed members individually as well as in any combination.

The articles "a" and "an" are used herein to refer to one or to more than one (i.e. to at least one) of the grammatical objects of the article. The phrases "in one aspect", "according to one aspect" and the like generally mean the particular feature, structure, or characteristic following the phrase is included in at least one aspect of the present disclosure, and may be included in more than one aspect of the present disclosure. Importantly, such phrases do not necessarily refer to the same aspect. If the specification states a component or feature "may", "can", "could", or "might" be included or have a characteristic, that particular component or feature is not required to be included or have the characteristic.

The term "elongated member" as used herein is a broad term that describes a structural member having a length dimension that is greater than its width.

The term "cylindrical" or "cylinder" has the ordinary meaning and generally refers to a geometrical shape having a surface traced by a straight line moving parallel to a fixed straight line and intersecting a fixed planar closed curve. These terms include cylinders whose cross section is circular, elliptical, oval, parabolic, or hyperparabolic.

The term "rectangle" or "rectangular" generally refers to the outer cross-sectional shape of a structure of the present disclosure. The term generally has the ordinary meaning of an equiangular quadrilateral. The term "square" in which all four sides are of the same length is one type of the class of "rectangles". In some aspects of a structure of the present disclosure, the rectangular-shaped outer cross section includes an outer surface that is slightly convex.

The term "secured" means a tight fastening of at least two components such that they move as one unit.

The term "resilient" is intended to mean that any change in shape due to the application of a force in the ordinary course of use of a unit will be followed by the unit springing back to its normally constant shape upon removal of the force.

The term "rare earth magnet or "rare earth magnetic material," is meant to mean any magnetic material or magnetizable material which contains at least one rare earth element therein, that is an element having an atomic number of from 57 to 71. Such rare earth elements can be contained in either minor or major amounts. Such rare earth magnets may also contain minor or major amounts of non-rare earth elements such as iron, cobalt, nickel, boron, and the like.

Figure 3:
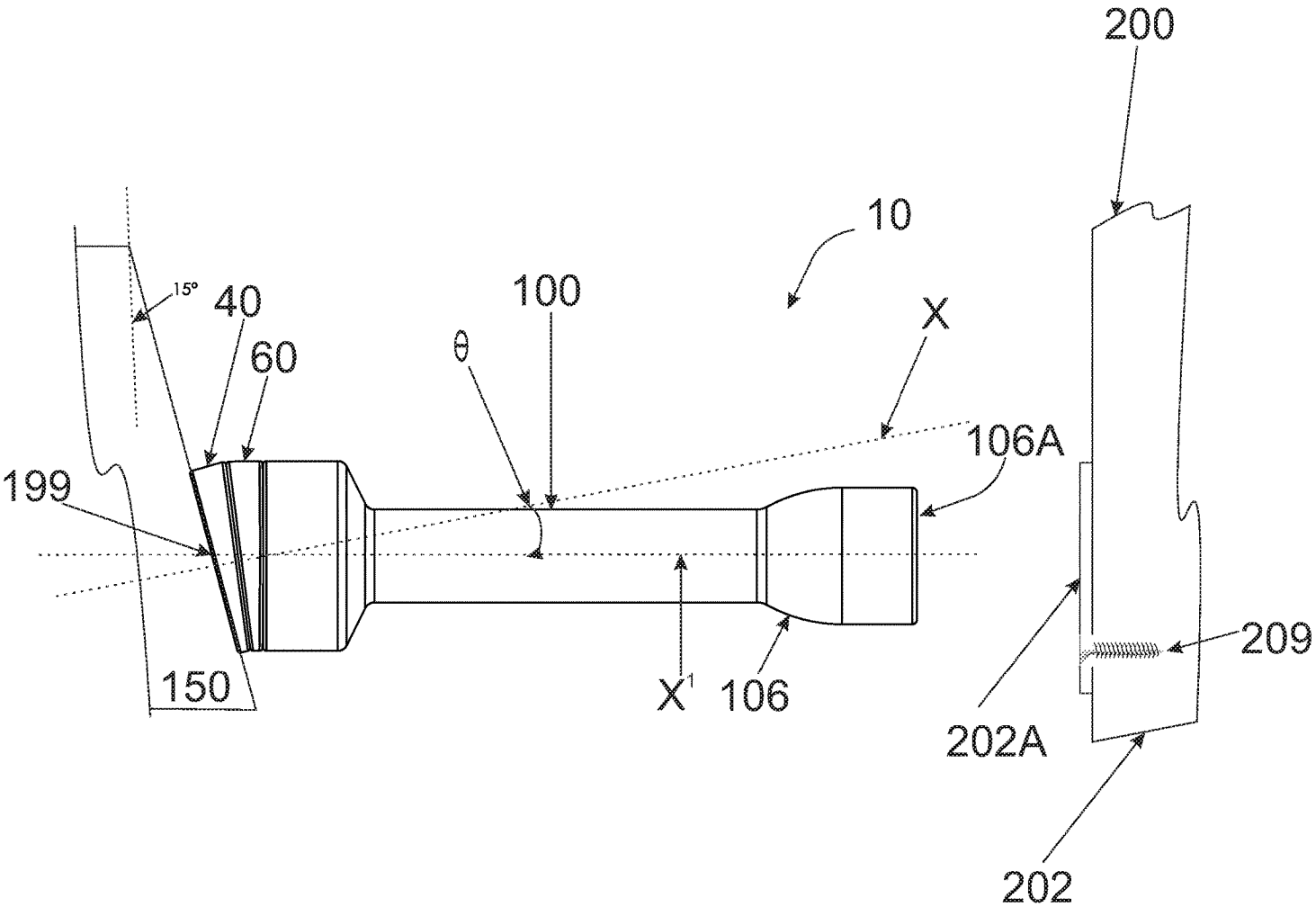
FIG. 3 is a side view of the door stop assembly of FIG. 1 with all components assembled and orientated at a range of movement angle θ.

With reference to FIGS. 1 and 3, a door stop assembly 10 according to one aspect of the present disclosure is provided. The door stop assembly 10 may generally include an elongated body/member 100 and an adjustable setting mount assembly 20 comprising a plurality of truncated discs having faces which upon engagement forms an indexing mechanism that may be used to incrementally select and adjust the position/orientation of the mount assembly. Thus, the adjustable setting mount assembly 20, when coupled to the elongated member 100, provides a door stop assembly 10 having a range of angular movement, defined by an angle θ measured in a vertical plane that is orthogonal to mounting surface 150, between a first position/orientation where the door stop assembly 10 extends in a direction X from the mounting surface 150 and a second position where the door stop assembly 10 extends in a direction X' from the mounting surface 150 as illustrated by the dotted lines. If the angular movement of elongated member 100 of door stop assembly 10 is through a range of angular positions in a vertical plane that is orthogonal to mounting surface 150, then the front surface of 106*a* of magnet 106 held at the distal end of elongated member 100 will remain substantially parallel to the surface of door 200 and of the outward facing surface 202*a* of a strike plate 202 that is secured to door 200. The longitudinal axis through body 100 may extend distal end 106 and be oriented substantially orthogonal to the surface 202*a* of strike plate 202.

According to one aspect, the range of angular movement defined by an angle θ with respect to the plane of the mounting surface 150 may be at least about 5°. In another aspect, the range of movement with respect to the plane of the mounting surface 150 may be from about 5° to: at least about 7.5°, or at least about 10°, or even at least about 12.5° or even still at least about 15°. In another aspect, the range of movement with respect to the plane of the mounting surface 150 may be from about zero to less than about 45°. In another aspect, the range of movement with respect to the plane of the mounting surface 150 may be less than about 30° or less than about 25°, or even less than about 20° or even still less than about 17.5°, and even still less than about 15°.

As shown in FIG. 1, in one particular aspect, the adjustable setting mount assembly 20 comprises a base truncated disk 40 for securing the door stop assembly 10 to a mounting surface 150 and an adapter truncated disk 60 for securing the adjustable mount setting assembly 20 to elongated member 100. In other aspects, adjustable setting mount assembly 20 may comprise additional truncated disks located between base truncated disk 40 and adapter truncated disk 60, such as, but not limited to, one or two or three or even greater than three additional truncated disks. This may provide additional flexibility in the choice and range of setting angles, as described hereinafter.

Base truncated disk 40 and adapter truncated disk 60 (along with additional truncated disks if present) may be truncated cylindrical disks, although in some aspects, the base and adapter truncated cylindrical disks (and additional cylindrical truncated disks if present) may not be perfectly round depending on the material of the disk or its manufacturing or assembly. According to another aspect, base truncated disk 40 and adapter truncated disk 60 (and additional truncated disks if present) may be truncated rectangular disks or any other truncated polygonal-shaped disk, such as truncated triangular or hexagonal disks.

Figure 4A:
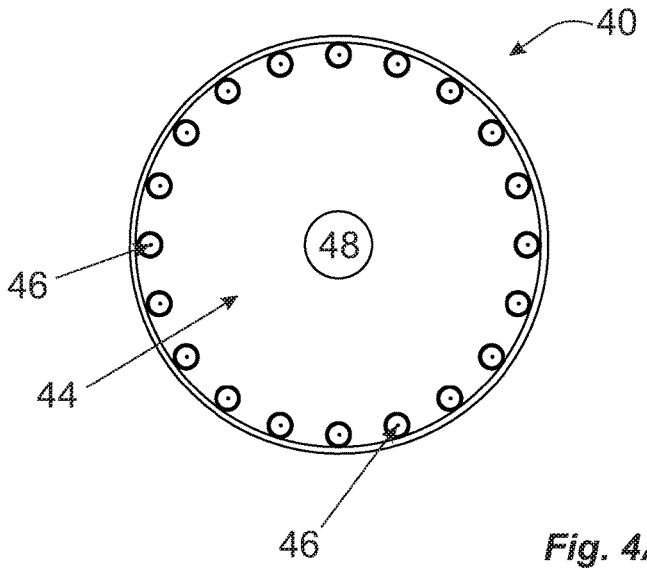
FIG. 4A is an end view of the base truncated disk of the door stop assembly, illustrating the first indexing engagement face.
Figure 4B:
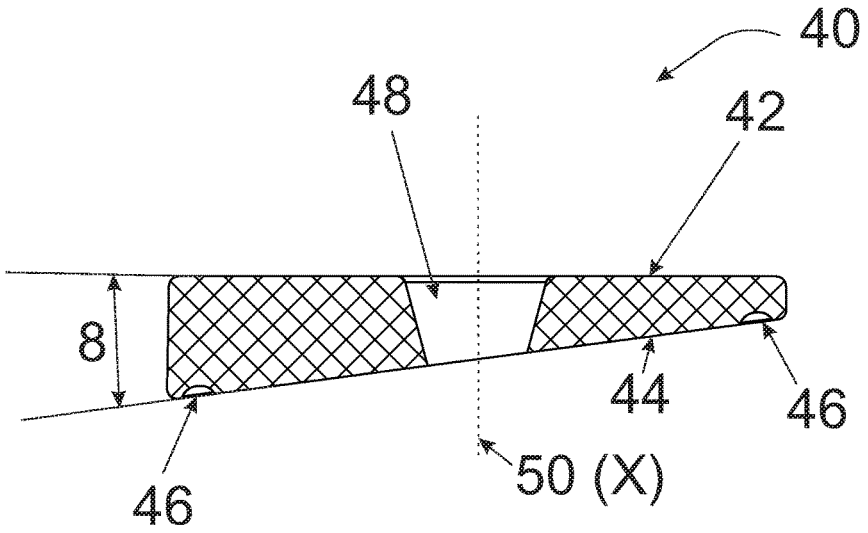
FIG. 4B is a side cross-sectional view of the base truncated disk shown in FIG. 4A.

With reference to FIGS. 2A, 2B, 4A and 4B, base truncated disk 40 may have a first axis 50 (FIG. 4B), a mounting face 42 at one end and a first engagement face 44 at the opposite end for interfacing with a second engagement face 64 of the adapter truncated disk 60. As shown in FIG. 4B, base truncated disk 40 forms a first wedge that decreases in width from one side to the other, preferably in a linear fashion, such that the plane of the mounting face 42 and the plane of the first engagement face 44 forms a first angle α.

As depicted in FIGS. 4A and 4B, a plurality of indexed recesses 46 may be spaced, in some aspects equally spaced, about the first engagement face 44, to correspond with at least one protrusion 66 extending from the second engagement face 64 of the adapter truncated disk 60. The plurality of recesses 46 define a plurality of indexed rotary or angular positions which the door stop assembly 10, once assembled, may assume relative to the mounting surface 150. When the first and second engagement faces 44, 64 are secured together, the adapter truncated disk 60 may be oriented such that the at least one protrusion 66 is brought into alignment and cooperative engagement with recesses 46 thereby preventing the adapter truncated disk 60 from rotating relative to the base truncated disk 40 unless the base and adapter truncated disks 40, 60 are axially uncoupled from one another.

In other aspects, the base and adapter truncated disks 40, 60 may be axially uncoupled to each other and the orientation of adapter truncated disk 60 relative to base truncated disk 40 may be adjusted by overcoming a predetermined threshold rotational force provided by a force application mechanism to unseat the one or more protrusions 66 from the plurality of recesses 46. One or both of the base/adapter truncated disks 40, 60 may be manufactured of resilient materials to enable the protrusions 66 to unseat from the recesses 46.

The base truncated disk 40 may also include a first aperture 48 located at its center or offset from its center for facilitating coupling and alignment with the adapter truncated disk 60. The first aperture 48 may be cylindrically shaped, while in further aspects the first aperture 48 may be polygonal shaped (for e.g. triangular, rectangular or hexagonal).

Figure 5A:
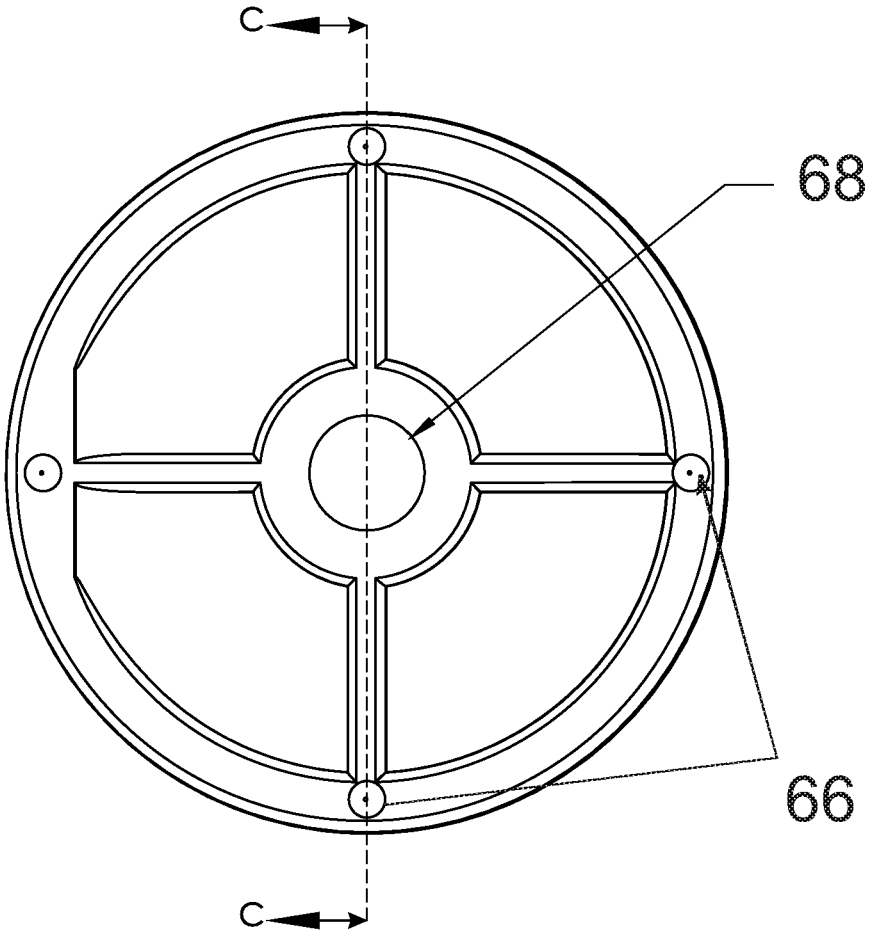
FIG. 5A is an end view of the adapter truncated disk of the door stop assembly, illustrating the complementary second indexing engagement face.
Figure 5B:
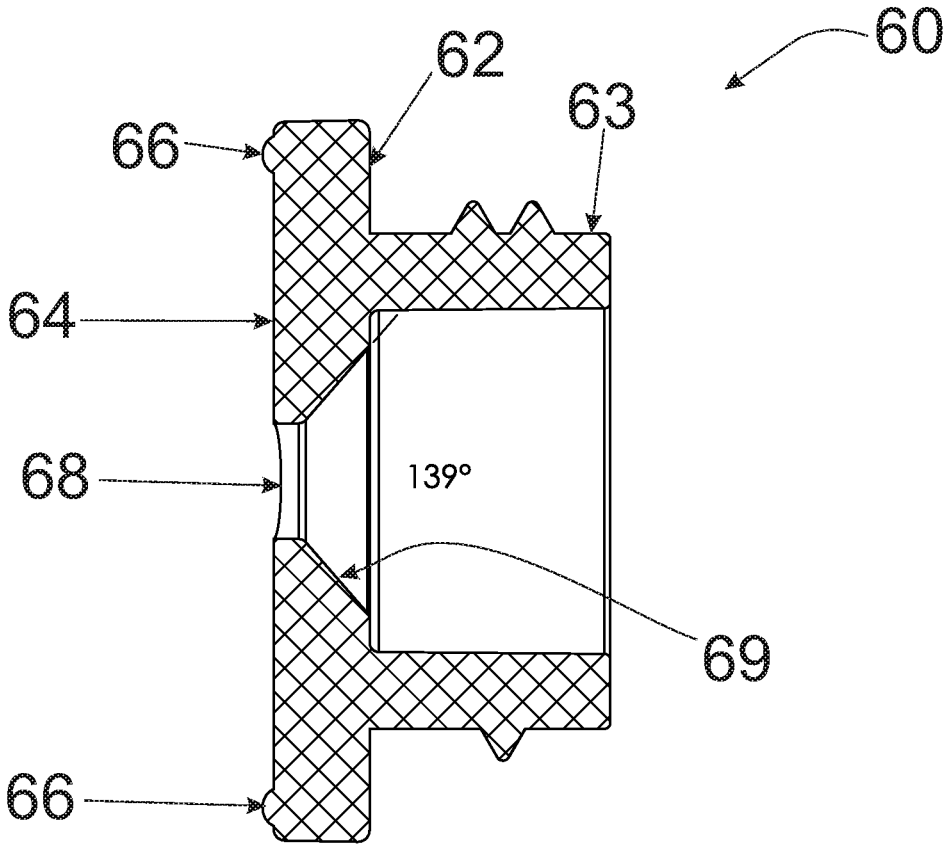
FIG. 5B is a side cross-sectional view of the adapter truncated disk shown in FIG. 5A along cut lines C-C.
Figure 5C:
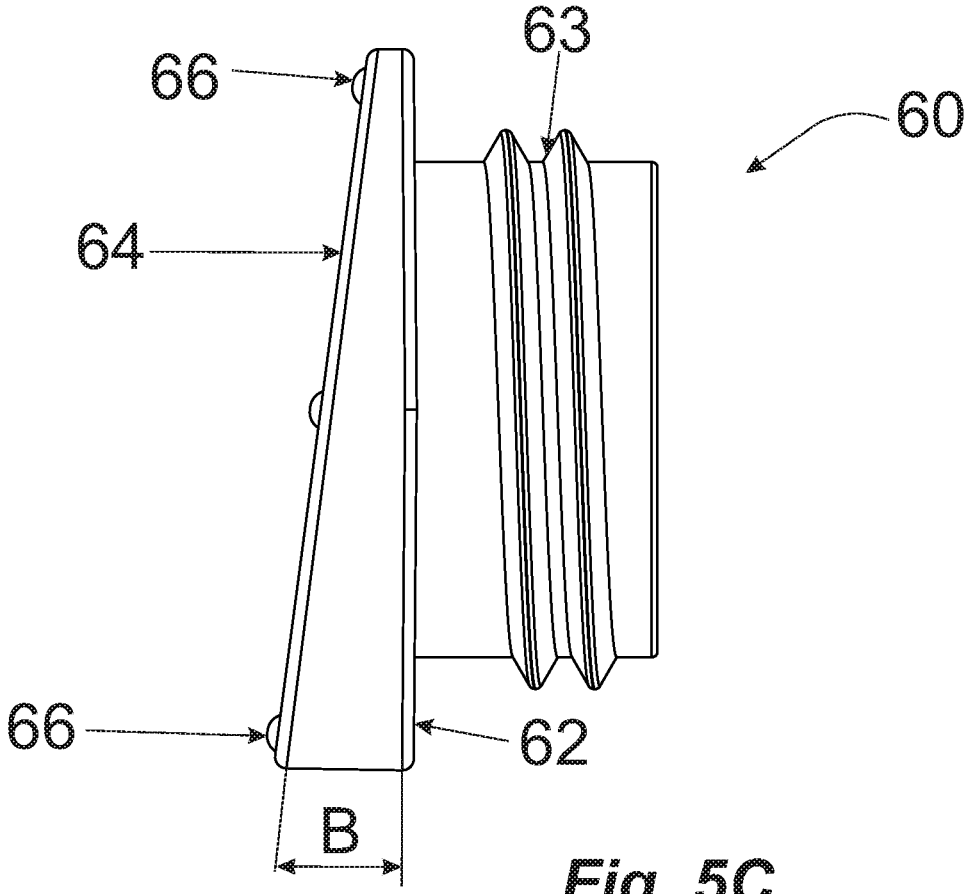
FIG. 5C is a side view of the adapter truncated disk shown in FIG. 5A.

With reference to FIGS. 2A, 2B, and 5A-5C, adapter truncated disk 60 may have a second axis 70, a second engagement face 64 at one end and a connecting face 62 at the opposite end for connecting with elongated member 100. Similar to base truncated disk 40, and as best shown in FIG. 5C, adapter truncated disk 60 decreases in width from one side to the other, in a complementary fashion to the plane of the base truncated disk 40. The plane of the connecting face 62 and the plane of the second engagement face 64 form a second angle β. A first connector 63 may be located on connecting face 62 to couple adapter truncated disk 60 with elongated member 100. In the depicted aspect, first connector 63 is an externally threaded extension extending from the connecting face 62 and parallel to second axis 70 for coupling with a female base of elongated member 100. In other aspects, connector 63 may be a threaded bore in the adapter truncated disk 60, a smooth bore, an extension, or any other suitable means of connecting to a complementary feature of elongated member 100.

According to one aspect, the base and adapter truncated disks 40 and 60 may be designed via their wedges and recesses/protrusions such that angles α and β are about equal. For example, base and adapter truncated disks 40, 60 may be designed such that angle α and angle β ranges between about 5° to about 10° or between about 6° to about 9° or between about 7° to about 8° with the proviso that angle α and angle β are within ±1° of each other or within ±0.75° of each other or within ±0.5° of each other or even within ±0.25° of each other.

Alternatively, the base and adapter truncated disks 40 and 60 may be designed via their wedges and recesses/protrusions such that angle α is either less than or equal to angle β. Thus, for example, base and adapter truncated disks 40, 60 may be designed such that angle α and angle β ranges between about 5° to about 10° or between about 6° to about 9° or between about 7° to about 8° with the proviso that angle α is less than or equal to angle β.

In still another aspect, the base and adapter truncated disks 40 and 60 may be designed via their wedges and recesses/protrusions such that angle α is greater than or equal to angle β. Thus, for example, base and adapter truncated disks 40 and 60 may be designed such that angle α and angle β may range between about 5° to about 10° or between about 6° to about 9° or between about 7° to about 8° with the proviso that angle α is greater than or equal to angle β.

As stated above, one or more protrusions 66 may extend from the second engagement face 64 and be spaced, sized, and shaped to correspond with the plurality of recesses 46 located on the first engagement face 44 of base truncated disk 40. Alternatively, the one or more protrusions may extend from the first engagement face 44 and be spaced, sized and shaped to correspond with a plurality of recesses located on the second engagement face 64 without deviating from the spirit and scope of the present disclosure.

The adapter truncated disk 60, like base truncated disk 40, may include a second aperture 68 located at its center or offset from its center for facilitating coupling and alignment with the base truncated disk 40. The second aperture 68 may be cylindrically shaped, although in further aspects the second aperture may be polygonal shaped (for e.g. triangular, rectangular or hexagonal). In addition, second aperture 68 may be shaped to permit rotation of the adapter truncated disk 60 relative to the base truncated disk 40 while being coupled to base truncated disk 40 via a connection mechanism that may be a mechanical fastener, including, but not limited to, a screw, bolt, nail, peg, rivet or clamp. For example, the mechanical fastener may be a screw 199 (FIG. 3) inserted through the first and second apertures 48, 68 and driven into the mounting surface 150 to rotatably couple base truncated disk 40 and adapter truncated disk 60 and secure adjustably setting mount assembly 20 to the mounting surface 150. In this exemplary aspect, second aperture 68 may include a bevel 69 to accommodate the shape of the screw as adapter truncated disk 60 is rotated relative to base truncated disk 40 and angle θ changes due to the angled shape of the base and adapter truncated disks 40, 60.

In another aspect, the mechanical fastener may be a rivet or any other suitable means of rotatably coupling truncated base disk 40 and adapter truncated disk 60 together. Base truncated disk 40 and/or adapter truncated disk 60 may also comprise additional apertures for securing the door stop assembly 10 to the mounting surface 150.

As stated above, one or more additional truncated disks may be located between base truncated disk 40 and adapter truncated disk 60 without deviating from the spirit and scope of the present disclosure. In such aspects, the one or more additional truncated disks may have the same features as the base truncated disk 40 and adapter truncated disk 60, such as an axis, aperture, and engagement faces having protrusions and recesses to cooperatively engage.

Figure 2A:
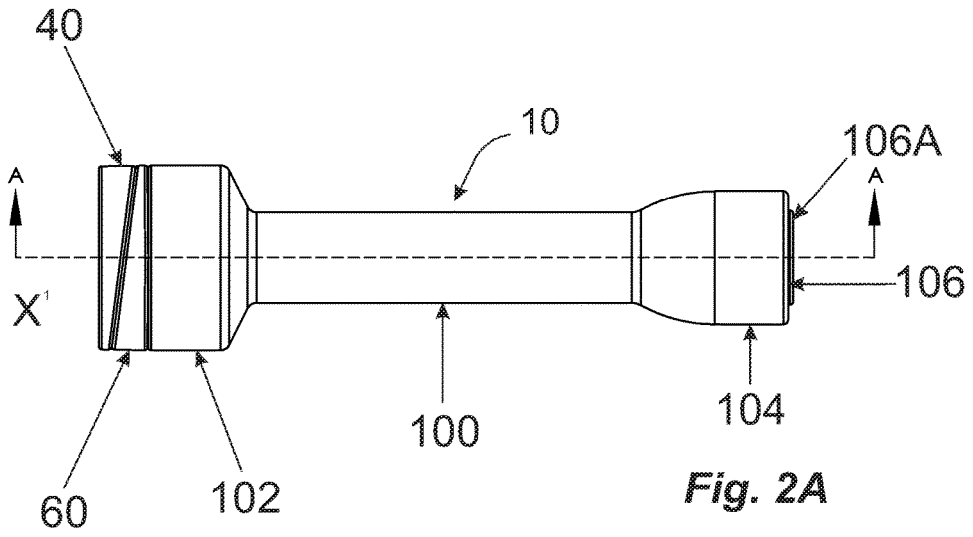
FIG. 2A is a side view of the door stop assembly of FIG. 1 with all components assembled and orientated along cut lines A-A.
Figure 2B:
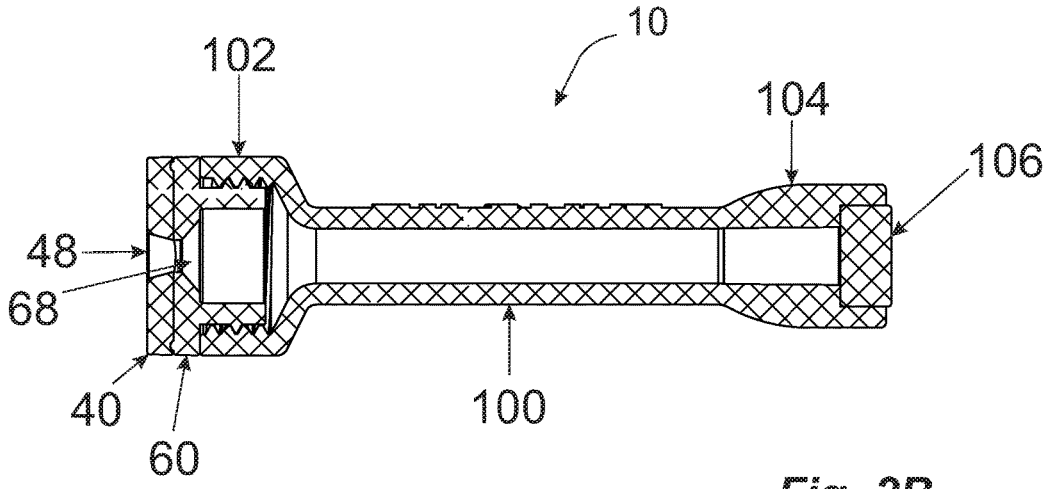
FIG. 2B is a side cross-sectional view of the door stop assembly shown in FIG. 2A.

With reference to FIGS. 1-2B, the elongated member 100 may include a connecting end 102 and a distal stop end 104. Although depicted as generally cylindrical in cross-section, elongated member 100 may have any another geometric shape, such as polygonal (for e.g. triangular, rectangular or hexagonal) in cross section without deviating from the spirit and scope of the present disclosure.

In order to couple elongated member 100 and adapter truncated disk 60, connecting end 102 of elongated member 100 may comprise a second connector 103 for cooperatively engaging with first connector 63 of adapter truncated disk 60. In the depicted aspect, second connector 103 is an internally threaded bore shaped to engage with the externally threaded extension of first connector 63. Alternatively, second connector 103 may be an externally threaded extension or any other suitable means for connecting to a complementary feature of the adjustable setting mount assembly 20.

Stop end 104 may comprise retaining mechanism 104 for preventing a surface, such as a door, from releasing therefrom and moving/closing unless a predetermined level of force is reached. Stop end 104 may also be used to prevent a door from slamming against a surface adjacent to the door. In the depicted aspect, retaining mechanism 104 comprises a magnet 106 for engaging with a strike plate 202 that may be attached to an adjacent mounting surface 200 (eg. a door surface), as shown in FIG. 3. The strike plate 202 may generally comprise a ferromagnetic material.

In one aspect, the magnet 106 may be selected from a material having sufficient strength such that at least about 10 pounds of force, or at least about 12.5 pounds of force, or even at least about 14.5 pounds of force, or even still at least about 15 pounds of force is required to overcome the magnetic force between the magnet 106 and the ferromagnetic material of strike plate 202 and allow magnet 106 to be released from the strike plate 202 and release the door from the open position.

In one aspect, the magnet 106 may comprise a rare earth magnet. Examples of rare earth magnets include, but are not limited to: neodymium or praseodymium, alone or in combination with iron and/or boron; and samarium or dysprosium, alone or in combination with iron and/or cobalt. In one particular aspect, the magnet 106 may comprise neodymium. In another aspect, the magnet 106 may comprise neodymium, iron and boron.

In other aspects, other means of retaining the door in open position may be used. For example, the retaining mechanism 104 and/or mounting surface 200 may include a suction device or a hook or loop portion of a hook-and-loop fastener for engaging with a corresponding loop or hook portion.

Although elongated member 100 is depicted as a straight, unitary member, it may be curved, or have any other suitable shape and/or configuration without departing from the spirit and scope of the present disclosure. For example the elongated member 100 may be an elongated body constructed from one or more components that are interconnected together.

Components of door stop assembly 100 may be manufactured by injection molding, milling, casting, combinations thereof, or any other process known in the art. In aspects, adjustable setting mount assembly 20 and elongated member 100 may be formed of a suitable plastic, metal, composite, rubber, polymer or combinations thereof.

According to one aspect, the adjustable setting mount assembly 20 and elongated member 100 may be formed of a suitable rigid plastic material. Such plastic materials may include, but are not limited to, polyethylene terephthalate (PET), polycarbonate, polypropylene, oriented polystyrene (OPS), biaxially oriented polypropylene (BOPP), polyvinyl chloride (PVC), polyester, acrylic, polystyrene, rigid polyvinyl chloride (RPVC) polyester, polyethylene, clear acetate plastic, acrylonitrile-butadiene-styrene (ABS), and mixtures thereof. In further aspects, the plastic material may be hypoallergenic.

The door stop assembly 10 may be used in methods for releasably holding a door in an open position and/or to prevent a door from slamming into an adjacent surface.

The first step may be to locate the elongated member 100 of the door stop assembly 10 about 6 cm from the bottom edge of the door or wall, whichever is shorter and about 4 cm above the ground. It is desirable to ensure that the bottom edge of the magnet 106 will be within about 2 cm from the bottom edge of the door surface when the door stop assembly is positioned on the supporting surface. This position is then marked on the door or wall mounting surface with a marker such as a pencil.

Next base truncated disk 40 and adapter truncated disk 60 may be coupled together at a desired selected relative angle to each other. The coupling together may be effected by inserting a long screw through respective apertures 48, 68, engaging the truncated disk 40 and adapter truncated disk 60 with each other at a desired angular orientation relative to each other, and attaching this combination to the mounting surface 150 where marked. As it is being secured to the mounting surface 150, the angular orientation of the coupled together base truncated disk 40 and adapter truncated disk 60 may be appropriately positioned so that when the elongated member 100 is attached thereto, elongated member 100 is appropriately angled in the correct direction (eg. such that elongated member 100 is substantially orthogonal to the door surface 200*a* in a vertical plane [FIG. 3]).

Next elongated member 100 of apparatus 10 may be attached to the threaded connector 63 of the combined truncated disk 40 and adapter truncated disk 60, located on adapter truncated disk 60, by rotating elongated member 100 to engage threaded connector 63 with threaded connector 103 of elongated member 100. Elongated member 100 may be rotated until it snugly engages with adapter truncated disk 60. Once it is firmly engaged with adapter truncated disk 60, further rotation of elongated member 100 can rotate the entire door stop assembly 10 to provide for the correct orientation of elongated member 100. Although base truncated disc 40 and adapter truncated disk 60 should be firmly screwed together when mounted to support surface 150 with screw 199, the connection to surface 150 should not be so tight that when elongated member 100 is attached to, the assembly can't be rotated to the appropriate angle.

Next, strike plate 200 may be placed against the distal end of the elongated member 100, with double faced tape attached to the strike plate facing towards the opposite surface of the door surface 200, with a hole at the bottom of the strike plate being aligned with the top of the magnet 106 at the distal end of elongate member 100. The door can then be brought into engagement with the strike plate 200 that is being held on the magnet 106 of elongated member 100, and the location of the top edge and side edge of the strike plate 200 can be marked (eg. with a pencil) on the door.

Next the door can be moved out of the way from being near to elongated member 100, and the double faced tape can be removed and thus the strike plate 200 can be stuck to the door surface at the locations marked. Thereafter the strike plate 200 can be attached to the door with one or more screws 209.

By way of further explanation relating to the assembly and installation of the door stop assembly 100 to the mounting surface, as depicted in FIGS. 1-3B, the door stop assembly 10 may be assembled and installed by aligning the first aperture 48 of base truncated disk 40 and the second aperture 68 of adapter truncated disk 60 in an appropriate relative angular orientation and then, inserting a mechanical fastener, for example a screw, through the first and second apertures 48, 68 and driving the screw into a mounting surface 150 until the base truncated disk 40 and adapter truncated disk 60 are coupled together and attached to the mounting surface 150. The screw may then be tightened until the one or more protrusions 66 engage with the corresponding plurality of recesses 46 such that adapter truncated disk 60 is secured to base truncated disk 40. Before being secured to the mounting surface 150, the orientation of base truncated disk 40 and adapter truncated disk 60 may be selected using the above-described indexing mechanism to compensate for the shape and/or angle of the mounting surface 150, which in some aspects may be a maximum of 15°.

For example, as shown in FIG. 3, if the mounting surface 150 is at a 15° angle relative to the vertical orientation, wherein the bottom portion of the mounting surface 150 extends farther outwards relative to the upper portion of the mounting surface 150, base truncated disk 40 may be installed such that the thicker side is closer to the upper portion of the mounting surface 150. The adapter truncated disk 60 may then be rotated such that the at least one protrusion 66 is brought into alignment and cooperative engagement with recesses 46 thereby preventing the adapter truncated disk 60 from rotating relative to the base truncated disk 40 and that its thicker side is also closer to the upper portion of the mounting surface 150 to further compensate for the angle of the mounting surface 150. The screw may then be tightened to secure the adjustable setting mount assembly 20 to the mounting surface 150 and prevent the orientation of the base truncated disk 40 and adapter truncated disk 60, and their orientations relative to each other, from changing. Elongated member 100 may then be coupled with the adjustable setting mount assembly 20 via adapter truncated disk 60 by connecting the second connector 103 and first connector 63. In the aspect depicted in FIG. 3, angles α and β combine to give a maximum range of movement (i.e. angle θ) of 15°, which fully compensates for the 15° incline of the mounting surface, thereby allowing the magnet 106 of retaining mechanism 104 to optimally engage with the strike plate 202 on mounting surface 200. In situations where the mounting surface 150 does not have a substantial incline, adapter truncated disk 60 may be easily rotated as described above in order to minimize the total compensation angle provided by the base and adapter truncated disks 40, 60.

Although the aspect depicted in FIG. 3 shows the door stop assembly 10 fixed to the inclined mounting surface 150, in alternative aspects, door stop assembly 10 may be fixed to mounting surface 200 without deviating from the spirit and scope of the present disclosure. Furthermore, although mounting surface 150 is shown as inclined and mounting surface 200 is shown as straight, mounting surface 150 and/or mounting surface 200 may be straight, inclined or any combination thereof. In aspects, mounting surface 150 and mounting surface 200 may be an interior door, an exterior door, an interior wall, an exterior wall (for e.g. a wall of a building or enclosure such as a garage, a storage shed or a metal storage container) a baseboard, a gate, a fence, a gate post and a combination thereof.

In a general aspect, a stop apparatus that may be constructed like door stop assembly 10 may be disposed between a surface of a first component and a surface of a second component. The first and second components may move relative to each other, and their corresponding facing surfaces may be oriented at different angles and may also be movable relative to each other. One component may be a component used to close an opening in the second component, such as door used to close an opening in a wall, or a gate used to close an opening in a fence.

Although making and using various embodiments of the present invention have been described in detail above, it should be appreciated that the present invention provides many applicable inventive concepts that can be embodied in a wide variety of specific contexts. The specific embodiments discussed herein are merely illustrative of specific ways to make and use the invention, and do not delimit the scope of the invention.

What is claimed is:

1. An adjustable stop apparatus comprising:

a base truncated disk comprising a mounting face for mounting on a first surface, a first engagement face opposite the mounting face and a first aperture extending through the mounting face and the engagement face wherein the base truncated disk forms a first wedge that decreases in thickness forming a base thick end and a base thin end;

an adapter truncated disk comprising a connecting face having a first connector, a second engagement face opposite the connecting face and a second aperture extending through the connecting face and the second engagement face wherein the adapter truncated disk forms a second wedge that decreases in thickness forming an adapter thick end and an adapter thin end; and an elongated member comprising a second connector configured to attach to the first connector and a distal stop end configured for engaging a second surface wherein the first engagement face and the second engagement face are configured to abut one another such that relative rotation about a fastener extending through the first aperture and the second aperture adjusts an angle of the adapter truncated disk and the elongated member with respect to the base truncated disk.

2. The adjustable stop apparatus of claim 1, wherein the first engagement face comprises a plurality of recesses spaced around the first aperture.

3. The adjustable stop apparatus of claim 2, wherein the second engagement face comprises at least one protusion for selective engagement with the plurality of recesses.

4. The adjustable stop apparatus of claim 1, wherein the first connector comprises an externally threaded extension and the second connector comprises an internally threaded member for engagement with the externally threaded extension.

5. The adjustable stop apparatus of claim 1, wherein the distal stop end comprises a retaining mechanism for releasably engaging the second surface.

6. The adjustable stop apparatus of claim 5, wherein the retaining mechanism comprises a magnet.

7. The adjustable stop apparatus of claim 1, wherein the elongated member, the base truncated disk and the adapter truncated disk are made from a hypoallergenic plastic.

8. An adjustable stop system comprising:

a first component having a first surface;

a second component having a second surface; and an adjustable stop apparatus comprising, a base truncated disk comprising a mounting face mounted on the first surface, a first engagement face opposite the mounting face and a first aperture extending through the mounting face and the engagement face wherein the base truncated disk forms a first wedge that decreases in thickness forming a base thick end and a base thin end;

an adapter truncated disk comprising a connecting face having a first connector, a second engagement face opposite the connecting face and a second aperture extending through the connecting face and the second engagement face wherein the adapter truncated disk forms a second wedge that decreases in thickness forming an adapter thick end and an adapter thin end; and an elongated member comprising a second connector configured to attach to the first connector and a distal stop end configured to engage the second surface wherein the first engagement face and the second engagement face are configured to abut one another such that relative rotation about a fastener extending through the first aperture and the second aperture adjusts an angle of the adapter truncated disk and the elongated member with respect to the base truncated disk and wherein the mounting face of the base truncated disk is mounted to the first surface and the distal stop end of the elongated member is adjacent to the second surface.

9. The adjustable stop system of claim 8, wherein the first component is a wall and the second component is a door.

10. The adjustable stop system of claim 8, wherein the first component is a door and the second component is a wall.

11. The adjustable stop system of claim 8, wherein the distal stop end of the elongated member comprises a retaining mechanism for releasably engaging the second surface.

12. The adjustable stop system of claim 11, wherein the retaining mechanism comprises a magnet.

13. The adjustable stop system of claim 12, further comprising a strike plate mounted on the second surface for providing a magnetic attraction with the magnet.

14. The adjustable stop system of claim 13, wherein the magnet comprises a rare earth magnet and the strike plate comprises a ferromagnetic material.

* * * * *